US008182220B2

(12) United States Patent
Li et al.

(10) Patent No.: US 8,182,220 B2
(45) Date of Patent: May 22, 2012

(54) KINETICALLY MODULATED FAN STRUCTURE

(75) Inventors: Hf Li, Dongguan (CN); Jack Cao, Kao-Chou (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 762 days.

(21) Appl. No.: 12/333,568

(22) Filed: Dec. 12, 2008

(65) Prior Publication Data

US 2009/0191055 A1 Jul. 30, 2009

(30) Foreign Application Priority Data

Jan. 25, 2008 (CN) ..... 2008 2 0004676

(51) Int. Cl.
*F01D 5/16* (2006.01)
*F03D 1/04* (2006.01)

(52) U.S. Cl. ..... 415/229; 415/220

(58) Field of Classification Search ..... 415/119, 415/220, 223; 416/189, 190, 246, 500, 244 R, 416/144, 145, 31
See application file for complete search history.

(56) References Cited

U.S. PATENT DOCUMENTS 4,107,257 A * 8/1978 Swin, Sr. ..... 264/275
5,399,070 A * 3/1995 Alizaden ..... 416/189

* cited by examiner

*Primary Examiner* — Thomas L Dickey
*Assistant Examiner* — Nikolay Yushin
(74) *Attorney, Agent, or Firm* — Grossman, Tucker, Perreault & Pfleger, PLLC

(57) ABSTRACT

A kinetically modulated fan structure is provided. The fan structure comprises a housing, a plurality of blades and an equilibrating structure, wherein the equilibrating structure is disposed on the inner side of the housing, and formed integrally with the housing and the blades. Thereby, the fan structure is adapted to be kinetically equilibrated during the manufacturing process. As a result, the modulation of the kinetic equilibrium with respect to the fan structure is eliminated since all of the yielded fan structures are uniform in quality. The simplified production is both time efficient and cost efficient, while producing a durable product.

6 Claims, 2 Drawing Sheets

KINETICALLY MODULATED FAN STRUCTURE

This application claims priority to China Patent Application No. 200820004676.8 filed on Jan. 25, 2008, the disclosure of which is incorporated herein by reference in its entirety.

CROSS-REFERENCES TO RELATED APPLICATIONS

Not applicable.

BACKGROUND OF THE INVENTION

1. Field of the Invention

The present invention relates to a fan structure, and more particularly, relates to a kinetically modulated fan structure.

2. Descriptions of the Related Art

With the rapid development of high-tech industries, various electronic products are becoming more functionally powerful. Accordingly, the power consumption of such products has also continuously increased, which imposes on the requirements needed for heat dissipation. Presently, the rotational speed of common heat dissipating fans needs to reach more than 3000 rpm and even up to above 7000 rpm when operating at high power. At such a high rotational speed, it is essential for the fan structures to be kinetically modulated appropriately to eliminate violent vibration and noises originating from the fans in operation. Unfortunately, to achieve kinetic equilibrium of the fan structures in the prior art is to add counterweights, counterbalance earth or to drill holes, which consumes time, cost and is unstable. Other methods for reaching kinetic equilibrium include hollowing plastic blades or adding a steel housing outside the fan blades. However, these methods also consume time, have high costs and complex manufacturing processes. Additionally, the added materials for kinetic modulation as described above are dissimilar to that of the fan structures, it is common for the materials to flake off after being used for a long time, resulting in a considerable decrease in the service life of fans which are not kinetically modulated well. On the other hand, when the fans are kinetically modulated by cutting off a portion of materials thereof, structural weak points tend to develop locally on the blades and are susceptible to stress concentration, thereby causing damage to the fan structures and consequent decrease in the service life thereof.

Because conventional methods, which perform modulation on individual fan structures after they are manufactured, are costly, time consuming and have complex processes, it is difficult for the yielded products to provide uniform and stable quality.

Therefore, it is highly desirable in the field to provide a fan structure that is cost efficient and time efficient to achieve kinetic equilibrium modulation, while preventing damage and providing uniform quality of the yielded products.

SUMMARY OF THE INVENTION

The objective of this invention is to provide a fan structure which makes an improvement to the conventional kinetic equilibrium modulating methods for fan blades. Specifically, when using the present invention, there is a shorter kinetic modulation time, a lower cost, a simpler process and a longer service life.

The kinetically modulated fan structure of this invention comprises a housing, a plurality of blades and an equilibrating structure. The housing has a side wall and a top wall with a periphery, while the side wall is disposed along the periphery of the top wall. The plurality of blades are disposed on an outer surface of the side wall. The equilibrating structure is disposed on an inner side of the housing and integrally formed with the housing and the plurality of blades. By integrally forming equilibrating structure, the fan structure of this invention is adapted to be kinetically equilibrated during the manufacturing processes such as injection molding. As a result, the modulation of kinetic equilibrium with respect to individual fan structures can be eliminated since all of the yielded fan structures are uniform and durable in quality. Thus, the kinetic modulation is both time efficient and cost efficient.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
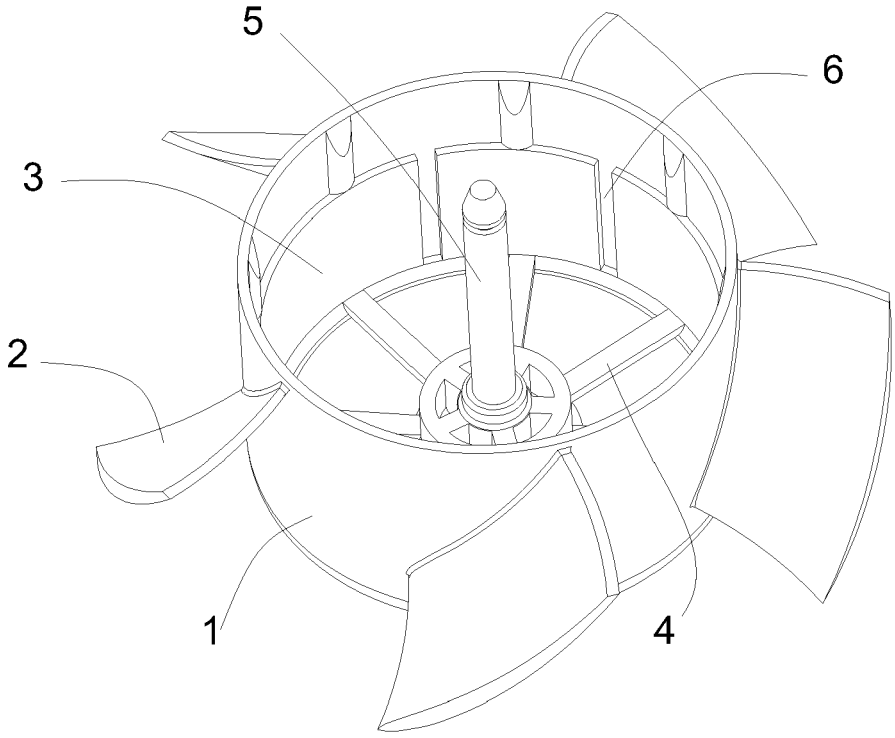
FIG. 1 is a perspective view of the first embodiment in accordance with this invention.

The fan structure of this invention utilizes an equilibrating structure disposed therein for kinetic equilibrium modulation. The fan structure comprises a housing, a plurality of blades, an equilibrating structure, a central rotary shaft 5 and a plurality of reinforcing ribs. As shown in FIG.1, the housing 1 comprises a side wall and a top wall. A plurality of reinforcing ribs 4 is disposed on the inner side of the top wall, although this invention is not merely limited to this arrangement. The side wall is disposed along a periphery of the top wall. The plurality of blades 2 are disposed on an outer surface of the side wall of the housing 1. An equilibrating structure is disposed on the inner side of the housing 1 and integrally formed with the housing 1 as well as the plurality of blades 2. The central rotary shaft 5 extends downward from the inner side of the top wall at a center thereof.

In the first embodiment of this invention, the equilibrating structure comprises at least one recess 6 disposed on the inner side of the side wall of housing 1 as shown in FIG. 1. However, in other examples, instead of being disposed on the inner side of the side wall of the housing 1, the equilibrating structure may also be disposed on the inner side of the top wall of the housing 1. The equilibrating structure may be also at least one protrusion formed on the inner side of the housing 1.

In the first embodiment, the fan structure further comprises an inner hub 3 integrally formed on the inner side of the side wall of the housing 1. The inner hub 3 is formed with the at least one recess 6 to define the equilibrating structure of this invention. As shown in FIG. 1, the equilibrating structure comprises a plurality of recesses 6 disposed on the inner hub 3, which corporately alter the mass distribution of the fan structure to modulate the kinetic equilibrium of the fan structure. It should be noted that a cross section of the recess 6 is not just limited to the quadrangular shape as shown in FIG. 1, but may also take on a curvilinear, triangular, polygonal shape or the like. Also, the recesses 6 may not extend to the inner side of the top wall of the housing 1, or extend downwards to the bottom of the inner hub 3, but may be formed only on a portion of the inner hub 3. All variations described above may achieve the goal of this invention.

Figure 2:
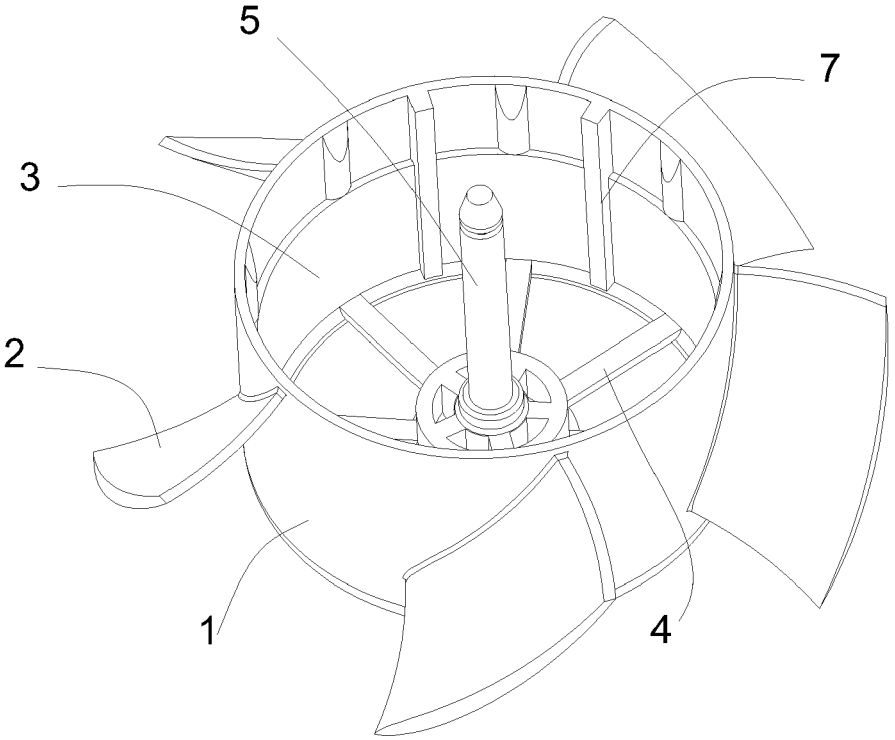
FIG. 2 is a perspective view of the second embodiment in accordance with this invention.

As shown in both FIGS. 1 and 2, similar to the first embodiment, a fan structure of the second embodiment of this invention also comprises an inner hub 3 and at least one recess 6. However, the second embodiment differs from the first embodiment in that the equilibrating structure further comprises at least one protrusion 7 integrally formed on an inner side of the side wall of the housing 2. The protrusion 7 protrudes inwardly from the side wall through the recess 6 and cooperates with the recess 6 to define the equilibrating structure. The protrusion 7 is not limited to the configuration shown in FIG. 2, but may also extend to the inner side of the top wall of the housing 1 or extend beyond the recess 6 up to the bottom of the side wall of the housing 1. Moreover, the protrusion 7 may protrude inwardly from only at least a portion of the recess 6 or may be constructed with different lengths and sectional shapes such as curvilinear, triangular, quadrangular and polygonal shapes. All these variations may achieve the goal of this invention. In the second embodiment, as shown in FIG. 2, the inner hub 3 is formed with a plurality of protrusions 7 inwardly protruding from the plurality of recesses 6 respectively. The plurality of protrusions 7 and the recesses 6 cooperate with each other to define the equilibrating structure for modulating the kinetic equilibrium of the fan structure.

Figure 3:
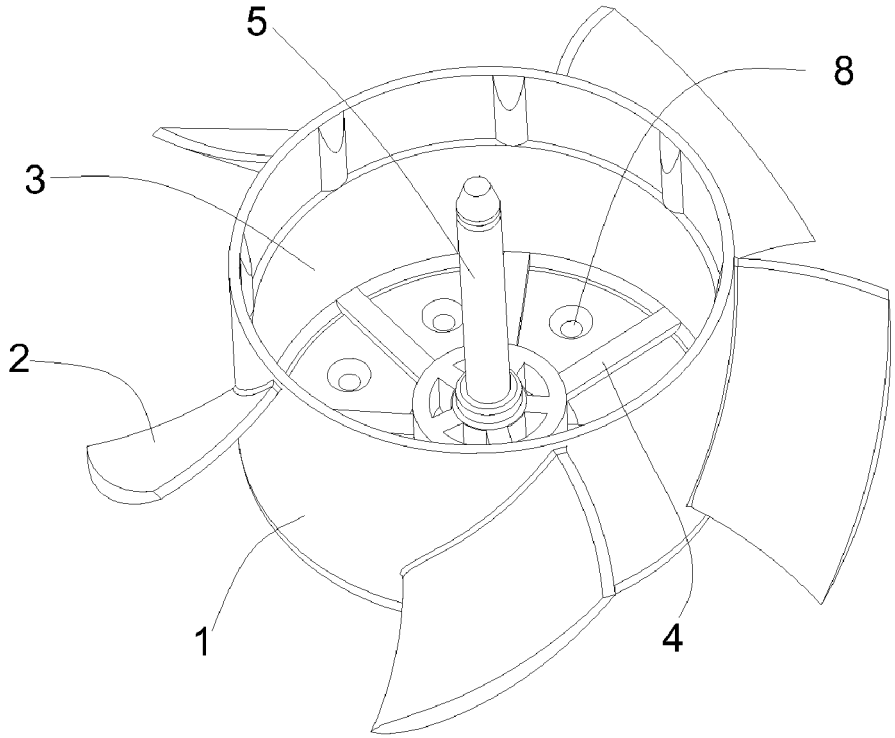
FIG. 3 is a perspective view of the third embodiment in accordance with this invention.

As shown in FIG. 3, a fan structure of the third embodiment of this invention differs from the first and the second embodiment in that the equilibrating structure thereof comprises at least one recess 8, which is integrally formed on the inner side of the top wall of the housing 1 to define the equilibrating structure and is adapted to kinetically modulate the fan structure. In this embodiment, the equilibrating structure comprises a plurality of recesses 8 integrally formed on the inner side of the top wall of the housing 1 and substantially shaped into circular blind holes. However, in other examples, the recesses 8 may also be blind holes or through-holes in a curvilinear, square, spherical, rectangular, polygonal shape or the like, all of which may achieve the goal of kinetic equilibrium modulation.

Figure 4:
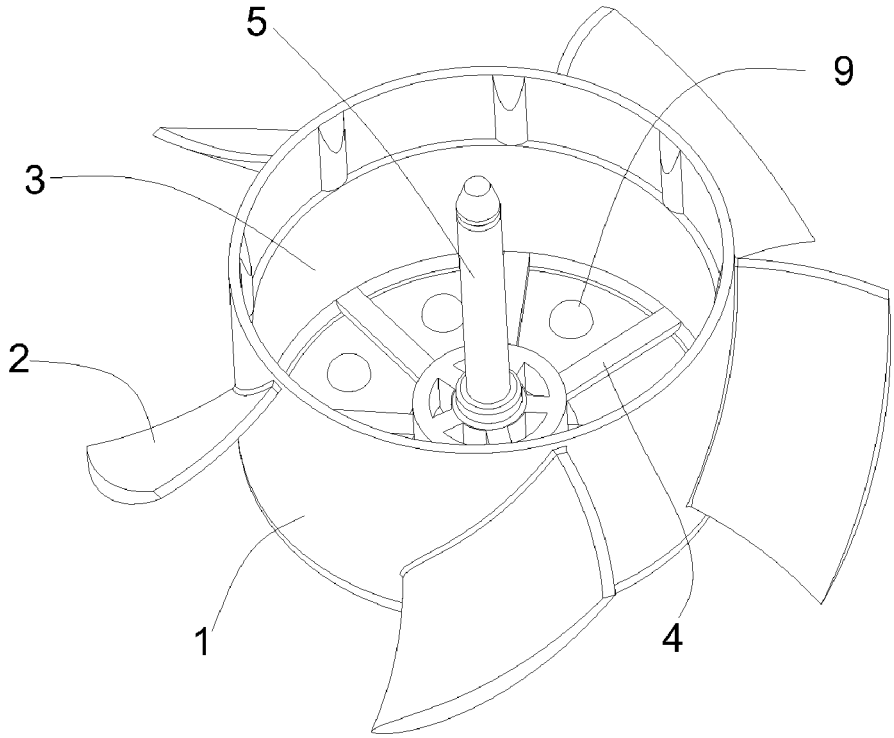
FIG. 4 is a perspective view of the fourth embodiment in accordance with this invention.

Similarly, in the fourth embodiment of this invention, the equilibrating structure is also integrally formed on the inner side of the top wall of the housing 1. However, unlike that described in the third embodiment, this equilibrating structure comprises at least one protrusion 9 as shown in FIG. 4 to define the equilibrating structure of this invention. The fan structure of this embodiment comprises a plurality of protrusions 9, which may be implemented as at least one portion of a sphere. However, in other examples, the protrusion 9 may also take on a cuboidal, cylindrical, conical, hexahedral, tetrahedral, polyhedral or other shapes, all of which variations may modulate the kinetic equilibrium of the fan structure appropriately without departing from the spirit of this invention.

The equilibrating structures described in the above embodiments are not merely limited to the configurations described therein. For example, the various recesses or protrusions described in the above embodiments may also be applied simultaneously in the fan structure to serve the purpose of kinetic equilibrium modulation for the fan structure.

When utilizing the equilibrating structure integrally formed in the fan structure in accordance with this invention, the fan structure can be readily kinetically modulated, thus eliminating the need for kinetic equilibrium modulation on individual fan structures. Consequently, the fan structures already kinetically modulated may be mass-produced by only appropriately adjusting the moulds used for manufacturing the fan structures. This not only saves considerable time consumed in kinetic equilibrium modulation, but also provides a uniform quality of the fan structures yielded, thus eliminating the disadvantages in the conventional methods for modulating the kinetic equilibrium of fan structures.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A kinetically modulated fan structure, comprising:

a housing having a side wall and a top wall which has a periphery, wherein the side wall is disposed along the periphery of the top wall;

a plurality of blades disposed on an outer surface of the side wall; and an equilibrating structure disposed on an inner side of the side wall, and integrally formed with the housing and the plurality of blades.

2. The kinetically modulated fan structure as claimed in claim 1, further comprising a central rotary shaft downwardly extending from the top wall at a center thereof.

3. The kinetically modulated fan structure as claimed in claim 2, further comprising an inner hub integrally formed on the side wall, wherein the inner hub is formed with at least one recess extending in parallel to the central rotary shaft to define the equilibrating structure.

4. The kinetically modulated fan structure as claimed in claim 3, wherein the inner hub is formed with a plurality of recesses each extending in parallel to the central rotary shaft to define the equilibrating structure.

5. The kinetically modulated fan structure as claimed in claim 2, further comprising an inner hub integrally formed on the side wall, wherein the inner hub is integrally formed with at least one protrusion extending along the inner side of the side wall and being in parallel to the central rotary shaft to define the equilibrating structure.

6. The kinetically modulated fan structure as claimed in claim 5, wherein the inner hub is integrally formed with a plurality of protrusions each extending along the inner side of the side wall and being in parallel to the central rotary shaft to define the equilibrating structure.

* * * * *